US007150522B2

(12) United States Patent
Sen

(10) Patent No.: US 7,150,522 B2
(45) Date of Patent: Dec. 19, 2006

(54) SEALABLE TOPCOAT FOR POROUS MEDIA

(75) Inventor: Radha Sen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 188 days.

(21) Appl. No.: 10/313,689

(22) Filed: Dec. 4, 2002

(65) Prior Publication Data

US 2004/0109957 A1 Jun. 10, 2004

(51) Int. Cl.
*B41J 2/01* (2006.01)

(52) U.S. Cl. ..... 347/101; 347/105; 428/32.1

(58) Field of Classification Search ..... 347/105, 347/101, 100; 428/195, 32.1
See application file for complete search history.

(56) References Cited

U.S. PATENT DOCUMENTS

| | | | |
|---|---|---|---|
| 6,140,390 | A | 10/2000 | Bugner et al. |
| 6,177,187 | B1 | 1/2001 | Niemoller et al. |
| 6,200,670 | B1 | 3/2001 | Hosoi et al. |

FOREIGN PATENT DOCUMENTS

| | | | |
|---|---|---|---|
| EP | 0858905 | A1 * | 8/1998 |
| EP | 03257386 | | 8/1998 |
| EP | 0908324 | A1 * | 4/1999 |
| EP | 1089470 | | 1/2001 |
| EP | 1078775 | A2 | 2/2001 |
| EP | 1078775 | A2 * | 2/2001 |
| EP | 1228891 | A2 * | 8/2002 |
| EP | 1228891 | | 8/2002 |
| JP | 09104164 | * | 4/1997 |

* cited by examiner

*Primary Examiner*—Manish S. Shah

(57) ABSTRACT

A process is provided that allows the production of an ink-jet recording media by applying a sealable topcoat to an ink-receptive coating on a substrate. A porous ink-receptive coating including a plurality of pores is applied to a surface of the substrate. An anionic porous topcoat consisting essentially of polymer particles having a $T_g$ in the range of 60° to 100° C. and a size less than 250 nanometers is applied on the porous ink-receptive coating. The topcoat is then dried at an elevated temperature and an image is printed on the topcoat of the ink-jet recording media using a conventional ink-jet printer. The topcoat is then heated until it becomes fused by using a heating device. The media formed provides the advantages of improved air fade resistance, good image quality and high gloss.

14 Claims, 1 Drawing Sheet

SEALABLE TOPCOAT FOR POROUS MEDIA

TECHNICAL FIELD

The present invention relates generally to ink-jet printing, and, more particularly, to improving the properties of an ink-receiving layer applied to a non-absorbent substrate.

BACKGROUND ART

Inorganic microporous ilnk-jet recording media is in wide use today for producing high quality images with fast print speed and rapid dry time. However, general exposure of inorganic microporous media based images to atmospheric contaminants can result in air fade, which physically alters the media and changes or degrades the image quality. It is desirable to enhance the permanence and quality of the images.

Prior solutions for addressing the problem of air fade include laminating a plastic sheet or transferring a polymer film over a printed image using thermal overcoat transfer. Lamination adds a second step to the printing process and the thermal overcoat transfer requires the use of a second web with the thermal overcoat material coated on it. Both of these approaches add complexity and cost.

Materials such as latexes having high glass-transition temperatures $T_g$ (95° to 110° C.) and large particle sizes on the order of 500 nanometers and above have been fused onto the surface of a printed image to provide image protection (water resistance, light fade resistance). However, this approach requires high temperature, above the glass transition temperature ($T_g$) of the latex, and pressure to heat and fuse the material.

Specific prior art attempts using latex, fused on an ink jet substrate have been made. However, even though coatings containing latex have been used in inkjet for some time, very little development has been made in using latexes for improving image permanence (specifically, air fade resistance) of photo quality ink jet images using inorganic microporous ink receiving layers.

Thus, what is needed is a process to enhance the permanence and quality of images printed on ink-jet recording media that avoids the problems of the prior art and provides a media with excellent air fade resistance.

DISCLOSURE OF INVENTION

In accordance with the embodiments disclosed herein, a process is provided that allows the production of an ink-jet recording media in which a sealable topcoat is applied to a porous ink-receptive coating on a substrate to improve image permanence and quality. The process comprises:

(a) applying a porous ink-receptive coating to a surface of the substrate, the porous ink-receptive coating comprising a plurality of pores;

(b) applying an anionic porous topcoat on the porous ink-receptive coating, the porous topcoat consisting essentially of polymer particles having a $T_g$ within a range of 60° to 1000° C. and a size less than 250 nanometers and, optionally, at least one pigment and at least one binder;

(c) drying the topcoat;

(d) printing an image on the topcoat of the ink-jet recording media with a dye-based ink; and (e) applying heat to the topcoat until the topcoat becomes transparent.

The polymer particles employed in the present embodiments are such that they are small and provide a good image quality even before sealing by heating in step (e). In the present embodiments, a two-layer system is employed, comprising the porous ink-receptive coating (inorganic imaging layer) and topcoat (optically clear sealable layer).

Thus, the approach provided here provides a method for enhancing image quality and permanence of photo quality inorganic microporous link receiving layers without giving up the benefits of fast print speed and dry time. Moreover, the approach describes the generation of an image that is of good quality prior to and fusing and the fusing step provides enhanced image quality and superior air fade protection.

Advantages over what has been done before include the use of a porous topcoat having a $T_g$ with a range of 60° to 100° C. and particles with a size of less than 250 nanometers. The topcoat is initially in an un-coalesced state that facilitates ink-jet printing of an image on the topcoat and immediate drying. Then the image is sealed using a source of heat. The sealed topcoat layer acts as an air barrier preventing attack of the image by atmospheric contaminants and resisting air fade. The particle size of the topcoat is selected to be large enough to allow dye penetration from the ink and favorably contribute to the image quality and gloss after sealing. Ink flow into the top porous layer is facilitated by the capillary action of the underlying ink-receiving layer. Additional air fade additives can be incorporated to improve image permanence.

BEST MODES FOR CARRYING OUT THE INVENTION

Reference is made now in detail to specific embodiments, which illustrates the best mode presently contemplated by the inventor for practicing the invention. Alternative embodiments are also briefly described as applicable.

Figure 1A:
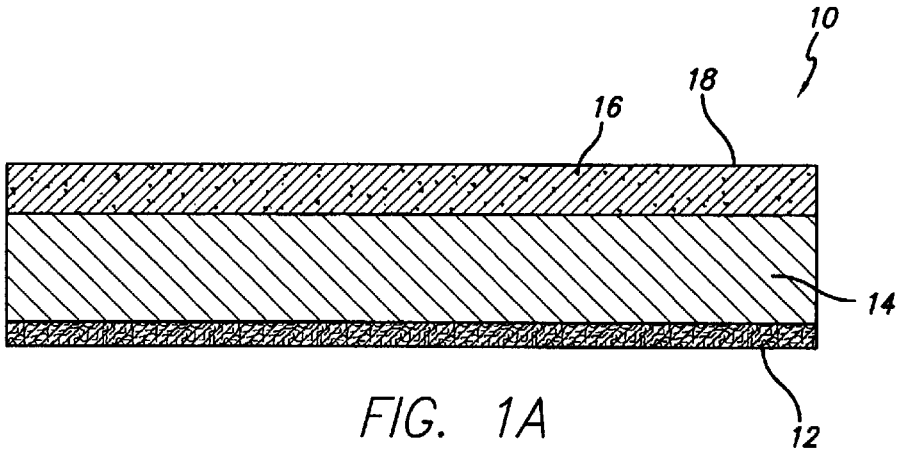
FIG. 1A is a schematic view, in section, of an embodiment of an ink-jet recording media prior to printing an image and the application of an ink.
Figure 1B:
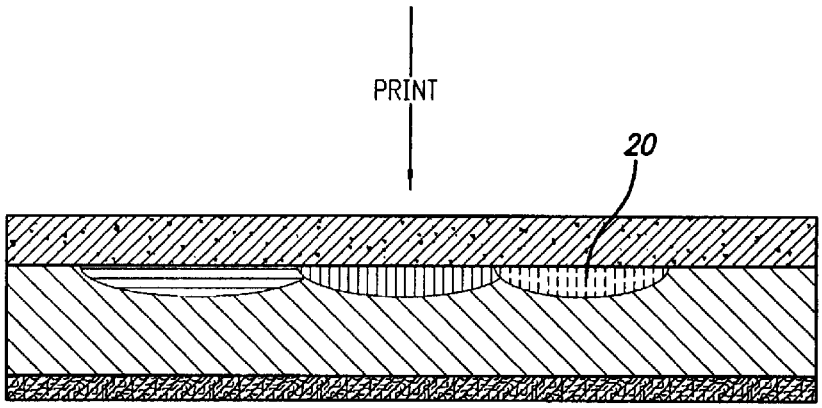
FIG. 1B is a schematic view, in section, of the ink-jet recording media after printing an image.
Figure 1C:
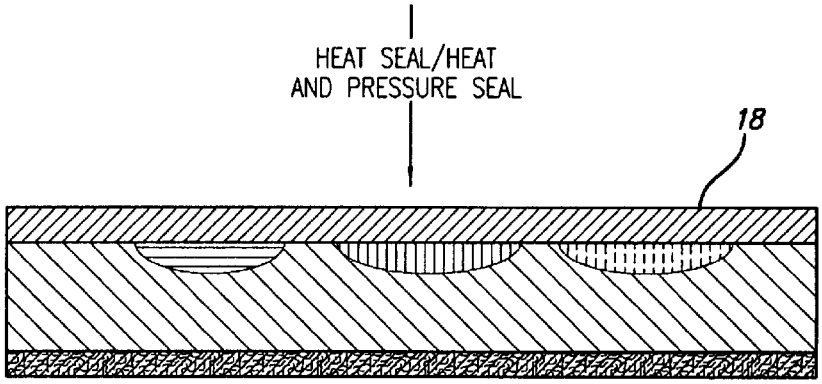
FIG. 1C is a schematic view, in section, of the ink-jet recording media after the heat seal/heat and pressure seal depicting the topcoat seal.

FIG. 1A depicts a schematic view of the ink-jet recording media 10 of the present invention. A porous basecoat (ink-receptive coating) 14 with a plurality of pores is applied to the surface of a non-permeable or permeable substrate 12. An anionic porous topcoat 18 with polymer particles 16, having a glass-transition temperature ($T_g$) in the range of 60° to 100° C. and a size in the range of 50 to 250 nanometers, is applied on the porous ink-receptive coating 14. The upper range of 250 nanometers is constrained by the desire to keep the polymer particles 16 transparent; at the upper range, the coating starts to become translucent.

The topcoat 18 is dried at a temperature in the range of 40° to 50° C., below the $T_g$ of the anionic porous topcoat 18. An image 20 is printed on the topcoat 18 of ink-jet recording media 10 and heat is applied to the topcoat is fused, or made nonporous.

The substrate 12 comprises a non-permeable or permeable film-coated papers or paperbase (e.g., photobase paper). The ink-receptive coating 14 comprises one or more pigments and one or more binders, and the topcoat 18 comprises one or more pigments and one or more binders.

The ink-receptive coating 14 contains one or more pigments independently selected from the group consisting of silica, alumina, hydrates of alumina, titania, carbonates, glass beads, and organic pigments selected from the group consisting of cross-linked SBR latexes, micronized polyethylene wax, micronized polypropylene wax, acrylic beads, and methacrylic beads.

The ink-receptive coating 14 contains one or more binders independently selected from the group consisting of polyvinyl alcohol and its derivatives, polyvinyl pyrrolidone/polyvinyl acetate copolymer, cellulose derivatives, acrylics, and polyurethanes.

The topcoat 18 contains one or more pigments selected from the group consisting of acrylic latexes, styrene acrylic latexes, and styrene-butadiene.

The topcoat 18 contains one or more binders independently selected from the group consisting of polyvinyl alcohol, polyvinyl acetate, polyvinyl acetal, poly acrylic acid, cellulosics, polyvinyl pyrrolidone, and polyurethanes.

The glass transition temperature of the topcoat 18 is at least 60° C. and no more than 100° C. The preferred range of $T_g$ is 70° to 80° C., and the particles have a preferred size in the range of 60 to 120 nanometers, which offers the best transparency of the polymer particles 16, and most preferably in the range of 100 to 120 nanometers. A heating device such as a laminator or a heat gun is used to apply heat to the topcoat 18 of the ink-jet recording media 10 at a preferred temperature range of 85° to 95° C. and a duration of 60 to 90 seconds, during which time the topcoat is fused.

In an alternative embodiment, a sealable topcoat 18 is applied to an ink-receptive coating on a substrate 12. A nano-porous ink-receptive coating 14 comprising one or more pigments, one or more binders, and a plurality of pores is applied to a surface of the substrate 12. A porous topcoat 18 comprising polymer particles 16, having a $T_g$ in the preferred range of 70° to 80° C. and a size in the preferred range of 60 to 100 nanometers, is applied on the nano-porous ink-receptive coating 14. The topcoat 18 is dried at a temperature in the range of 40° to 50° C. An image 20 is printed on the topcoat 18 of the ink-jet recording media 10 and heat is applied to the topcoat 18 until it becomes clear or transparent.

The process disclosed herein allows the production of an ink-jet recording media in which a sealable topcoat can be applied to a porous ink-receptive coating to improve image permanence and print quality.

The present embodiments are directed to polymer particles and the polymer particles in the topcoat are a subset of pigments. The polymer particles of the present invention have a size less than 250 nanometers and a preferred size within a range of 50 to 250 nanometers, as mentioned above. The prior art has utilized particles having significantly larger sizes and/or different processes and substrates.

The embodiments disclosed herein provide the advantages of improved air fade resistance, good image quality and high gloss. By using a porous topcoat having a $T_g$ with a range of 60° to 100° C. and particles with a size of 50 to 250 nanometers, the topcoat is initially in an un-coalesced state that facilitates ink-jet printing of an image on the topcoat and immediate drying. Then the image is sealed using a contact type, infra-red type heater or a heating gun (convective heating). The sealed topcoat layer acts as an air barrier, preventing attack of the image by atmospheric contaminants and resisting air fade. The particle size of the topcoat is selected to be large enough to allow dye penetration from the ink and favorably contribute to the image quality and gloss after sealing. Additional air fade additives can be incorporated to improve image permanence.

Preferably, a laminator is used to seal the topcoat 18, using a combination of temperature and pressure. The pressure is conventional in such laminators, typically on the order of 15 to 20 psi.

EXAMPLES

Example 1

Preparation of Sealable Topcoat

An ink-jet recording media was prepared on either a film-based substrate (Mylar) or a resin-coated paper substrate (photobase paper). An ink-receptive coating was prepared using a conventional microporous basecoat primarily consisting of large surface area inorganic pigment (alumina—pseudo-boehmite), and binder (polyvinyl alcohol).

A topcoat consisting of 0.5 to 2 grams per square meter coating of acrylic latex (anionic styrene/acrylic) having a $T_g$ of 70° to 80° C. and a particle size of 60 to 250 nanometers in polyvinyl alcohol (PVA) was prepared, in which the concentration of the acrylic latex was 85 to 95 parts by weight and the balance (15 to 5 parts by weight) was PVA. The topcoat was coated on the ink-receptive coating. The topcoat was dried in an oven at 40° C. An image was printed on the topcoat of the ink-jet recording media using a Hewlett-Packard DeskJet 970C printer. A heat gun located approximately 6 to 7 inches from the ink-jet recording media was used to apply convective heat to the image at a temperature of approximately 95° C. for a duration of 60 to 75 seconds.

The following Table IA lists the results for four different topcoat sealing conditions (Examples 2 and 4-6), compared with samples without sealing (Examples 1, 3, and 7). The thickness of the topcoat is given in grams per square meter (gsm). The acrylic latex topcoat comprised a mixture of a first composition (25 wt %) having an average particle size of 221 nm and a glass transition temperature of 95° C. and a second composition (75 wt %) having an average particle size of 106 nm and a glass transition temperature of 50° C. The basecoat (ink receptive layer) in all four examples comprised microporous inorganic alumina.

In Examples 1 and 3, no sealing was used, while in Example 2, sealing was done at 85° using a IR heat source, and in Examples 4-7, sealing was done at 90° C., using a contact type heater. Example 7 is the non top coated media heated using the contact heater. Also listed are the color gamut, the distinctiveness of image (how sharp the image is from light reflected off the print surface), the 20 degree gloss average, the L*a*b* (how colored the media is), the black optical density (in kilo-optical density units), the humid bleed (after 4 days at 30° C. and 80% relative humidity), and the humid color fastness (same conditions).

Table IB lists the results of an air fade experiment, in which the printed images were kept in an air fade chamber for three weeks, with air flowing over the images at a rate of 300 to 400 ft/min.

TABLE IA

Results of Different Topcoating Conditions Compared with No Topcoat.

| Example | Anionic Styrene Acrylic Topcoat Composition | Gamut | Distinctiveness of Image (DOI) | 20 Degree Gloss Ave. | L*min | KOD | L*/a*/b* | Humid Bleed | Humid Color Fastness (HCF) |
|---|---|---|---|---|---|---|---|---|---|
| 1 | no topcoat | 415526 | 57 | 64 | 15.2 | 1.76 | 96.83/0.69/−3.88 | | |
| 2 | 1 gsm (IR Heater) | 389166 | 17 | 25 | 16.4 | 1.55 | 96.33/0.62/−4.11 | | |
| 3 | 1 GSM (Unsealed) | 349583 | 28 | 33 | 21 | 1.54 | 96.78/0.57/−4.01 | | |
| 4 | 1.1 gsm (Contact Heater) | 373127 | 45 | 59 | 18.7 | 1.63 | 96.2/0.52/−4.05 | 36.8 | 3.7 |
| 5 | 2.2 gsm (Contact Heater) | 390067 | 66 | 73 | 17.8 | 1.68 | 96.21/0.58/−4.01 | 36.9 | 4.7 |
| 6 | 2.9 gsm (Contact Heater) | 404346 | 48 | 48 | 15.9 | 1.64 | 96.12/0.62/−4.03 | 36.4 | 5.8 |
| 7 | no topcoat (Contact Heater) | 387707 | 21 | 21 | 17 | 1.68 | 96.9/0.70/−4.00 | 35.2 | 4.4 |

TABLE IB

Results of Air Fade Tests.

| | 3 Weeks in AF1 | | | |
|---|---|---|---|---|
| Example | % Black Loss | % Cyan Loss | % Magenta Loss | % Yellow Loss |
| 1 | 27.6 | 20.0 | 31.0 | 11.3 |
| 2 | 3.31 | 1.65 | 1.67 | 0 |
| 3 | 24.5 | 20.2 | 33.4 | 7.82 |
| 4 | 0.95 | 1.40 | 0.21 | 0.88 |
| 5 | 1.88 | 0.78 | 4 | 1.28 |
| 6 | 2.04 | 3.65 | 6.03 | 0.85 |
| 7 | 26.9 | 16.9 | 28.2 | 12.5 |

From the foregoing Tables, the following observations may be made. With regard to color gamut, it is desired that the value be as close to the gamut of high-end ink-jet swellable media; that number is about 450,000. Example 1 is the control not subjected to sealing conditions and Example 7 is a control subjected to sealing conditions. The properties of the top coated and sealed material is compared to that of a control subjected to sealing conditions to separate the effect of the sealing conditions from that of the sealing material itself. Therefore all the properties of the sealed material (Examples 2 and 4–6) are compared to Example 7. It can be seen that Examples 5 and 6 are superior to the control (Example 7). With regard to DOI, it is seen that all three topcoatings are superior to the control. With regard to 20 degree gloss average, again, all three topcoatings are superior to the control. With regard to L*min, this value should be close to the control. Examples 5 and 6 are seen to be superior to Example 4. The black optical density is acceptable for all samples. With regard to L*a*b*, the self-sealing layer does not impart color to the topcoating and therefore L*a*b* is comparable to the print media without the topcoating. Thus, the color gamut is not compromised. With regard to humid bleed and humid color fastness, the sealed material is similar to unsealed control.

INDUSTRIAL APPLICABILITY

The topcoating process disclosed and claimed herein is expected to find use in providing ink-receiving coatings on non-absorbent substrates.

What is claimed is:

1. An improved process for producing an ink-jet recording media by applying a sealable topcoat to an ink-receptive coating on a substrate comprising:

(a) applying a porous ink-receptive coating to a surface of said substrate, said porous ink-receptive coating comprising a plurality of pores;

(b) applying an anionic porous topcoat on said porous ink-receptive coating, said porous topcoat consisting essentially of polymer particles having a $T_g$ within a range of 60° to 100° C. and a size less than 250 nanometers and, optionally, at least one pigment and at least one binder;

(c) drying said topcoat at a temperature below said $T_g$;

(d) printing an image on said topcoat of said ink-jet recording media with a dye-based ink, and (e) applying heat to said topcoat above the $T_g$of the polymer and within said $T_g$ range until said topcoat is fused.

2. The process of claim 1 wherein said polymer particles have a size within a range of 50 to 250 nanometers.

3. The process of claim 1 wherein said ink-receptive coating comprises at least one pigment, and at least one binder and wherein said topcoat additionally consists essentially of said at least one pigment, selected from the group consisting of acrylic latexes, styrene acrylic latexes, and styrene-butadiene, and said at least one binder.

4. The process of claim 3 wherein said ink-receptive coating contains at least one pigment selected from the group consisting of silica, alumina, hydrates of alumina, titania, carbonates, glass beads, and organic pigments selected from the group consisting of cross-linked SBR latexes, micronized polyethylene wax, micronized polypropylene wax, acrylic beads, and methacrylic beads.

5. The process of claim 3 wherein said ink-receptive coating contains at least one binder independently selected from the group consisting of polyvinyl alcohol and its derivatives, polyvinyl pyrrolidone/polyvinyl acetate copolymer, cellulose derivatives, acrylics, and polyurethanes.

6. The process of claim 3 wherein said topcoat contains at least one binder independently selected from the group consisting of polyvinyl alcohol and its derivatives, polyvinyl pyrrolidone/polyvinyl acetate copolymer, cellulose derivatives, acrylics, and polyurethanes polyvinyl alcohol, polyvinyl acetate.

7. The process of claim 1 wherein said topcoat has a $T_g$ within a range of 70° to 80° C.

8. The process of claim 1 wherein said polymer particles of said topcoat have a size within a range of 60 to 120 nanometers.

9. A process for applying a sealable topcoat to an ink-receptive coating on a substrate comprising:

(a) applying a nano-porous ink-receptive coating to a surface of said substrate, said nano-porous ink-receptive coating comprising at least one pigment, one binder, and a plurality of pores;

(b) applying a porous topcoat on said nano-porous ink-receptive coating, said porous topcoat consisting essentially of polymer particles having a $T_g$ within a range of 70° to 80° C. and a size within a range of 60 to 120 nanometers and, optionally, at least one pigment and at least one binder;

(c) drying said topcoat at a temperature within a range of 40° to 50° C.;

(d) printing an image on said topcoat of said ink-jet recording media with a dye-based ink; and (e) applying heat to said topcoat until said topcoat is fused.

10. The process of claim 9 wherein said nano-porous ink-receptive coating contains at least one pigment selected from the group consisting of silica, alumina, hydrates of alumina, titania, carbonates, glass beads, and organic pigments selected from the group consisting of cross-linked SBR latexes, micronized polyethylene wax, micronized polypropylene wax, acrylic beads, and methacrylic beads.

11. The process of claim 9 wherein said ink-receptive coating contains at least one binder independently selected from the group consisting of polyvinyl alcohol and its derivatives, polyvinyl pyrrolidone/polyvinyl acetate copolymer, cellulose derivatives, acrylics, and polyurethanes.

12. The process of claim 9 wherein said topcoat additionally consists essentially of said at least one pigment, selected from the group consisting of acrylic latexes, styrene acrylic latexes, and styrene-butadiene, and said at least one binder.

13. The process of claim 12 wherein said topcoat contains at least one binder independently selected from the group consisting of polyvinyl alcohol and its derivatives, polyvinyl pyrrolidone/polyvinyl acetate copolymer, cellulose derivatives, acrylics, and polyurethanes.

14. The process of claim 9 wherein a heating device applies heat to said topcoat of said ink-jet recording media at a temperature within a range of 85° to 95° C. and for a duration of 60 to 90 seconds, during which time said topcoat becomes clear or transparent and fused.

* * * * *

UNITED STATES PATENT AND TRADEMARK OFFICE

CERTIFICATE OF CORRECTION

PATENT NO. : 7,150,522 B2
APPLICATION NO. : 10/313689
DATED : December 19, 2006
INVENTOR(S) : Radha Sen It is certified that error appears in the above-identified patent and that said Letters Patent is hereby corrected as shown below:

Col. 1 (line 61), after "optionally," delete "at least one pigment and".

Col. 6 (line 33), delete "pigment" and insert therefor --polymer--.

Col. 7 (line 3), after "optionally," delete "at least one pigment and".

Col. 8 (line 5), after "topcoat", delete "addition-".

Col. 8 (line 6), before "consists", delete "ally".

Col. 8 (line 6), delete "pigment" and insert therefor --polymer--.

Signed and Sealed this

Seventh Day of August, 2007

JON W. DUDAS
*Director of the United States Patent and Trademark Office*